US007641128B2

(12) United States Patent
Remington et al.

(10) Patent No.: US 7,641,128 B2
(45) Date of Patent: Jan. 5, 2010

(54) RAIL BRACE ASSEMBLY

(75) Inventors: James A. Remington, Sheffield Village, OH (US); Karl E. Axthelm, Chagrin Falls, OH (US); Phillip R. Merrifield, Streetsboro, OH (US)

(73) Assignee: Cleveland Track Material, Inc., Cleveland, OH (US)

( * ) Notice: Subject to any disclaimer, the term of this patent is extended or adjusted under 35 U.S.C. 154(b) by 491 days.

(21) Appl. No.: 11/478,238

(22) Filed: Jun. 29, 2006

(65) Prior Publication Data

US 2008/0000999 A1 Jan. 3, 2008

(51) Int. Cl.
*B61B 9/00* (2006.01)

(52) U.S. Cl. ..... 238/333; 238/336; 238/354

(58) Field of Classification Search ..... 238/333, 238/336, 310, 324, 325, 328, 327 A, 337, 238/349, 347, 292, 354, 361, 315
See application file for complete search history.

(56) References Cited

U.S. PATENT DOCUMENTS 1,426,772 A * 8/1922 Rapp ..... 238/336
1,501,319 A * 7/1924 Dooley
1,638,739 A * 8/1927 Maney
2,426,137 A * 8/1947 Asselin
2,525,185 A * 10/1950 Schulze ..... 238/292
4,566,630 A * 1/1986 Keiper, Jr.
4,770,342 A * 9/1988 Farrell et al.
4,824,015 A * 4/1989 Farrell et al.
5,104,041 A * 4/1992 Remington
6,308,897 B1 * 10/2001 Remington et al.
6,517,008 B1 * 2/2003 Remington et al.
2004/0056109 A1 * 3/2004 Weaver

* cited by examiner

*Primary Examiner*—Mark T Le
(74) *Attorney, Agent, or Firm*—Roger A. Gilcrest

(57) ABSTRACT

A rail brace assembly is adapted to buttress the head of a stock rail selected from one of two different stock rail groups mounted on the top surface of a brace plate. The assembly includes a stop block assembly also is affixed to the brace plate top surface. A rail brace moveable between a first brace position in which it buttresses the head of a rail from a first stock rail group and a second brace position in which it buttresses the head of a rail from a second stock rail group, has a pair of spaced side walls, a upwardly facing top surface, first rail group head and base fishing surface contact areas, second rail group head and base fishing surface contact areas, a first rail group brace plate contact surface and a second rail group brace plate contact surface. An elastic fastener cooperates with a clip housing to clamp the rail brace against the stock rail. When the rail brace is in the first brace position the first rail group head and base fishing surface contact areas engage the rail head and base fishing surface areas, the first rail group brace plate contact surface contacts the brace plate and the second rail group head fishing surface contact area engages the stop block assembly. When the rail brace is in the second brace position the second rail group head and base fishing surface contact areas engage the head and base fishing surfaces of the stock rail, the second rail group brace plate contact surface contacts the brace plate and the first rail group head fishing surface contact area engages the stop block assembly.

16 Claims, 5 Drawing Sheets

RAIL BRACE ASSEMBLY

CROSS-REFERENCES

None.

FIELD OF THE INVENTION

This invention relates to a universal rail brace assembly for a railroad track stock rail.

BACKGROUND OF THE INVENTION

Rail braces are used to buttress railroad rails against side thrusts exerted by the wheels of rail traffic tending to overturn them. Side thrusts of a magnitude sufficient to overturn a rail most commonly occur at turnouts or at curved sections of the rail which are subjected to high speed rail traffic or heavily loaded rail traffic. When a rail is overturned, the head of the rail is rotated about its origin to a position in which it is offset angularly with respect to a straight line extending from the base through the vertical axis of the rail. The head of a rail rotates with respect to the base of a rail when the lateral forces exerted by rail traffic on the head of the rail are of sufficient magnitude to overcome the force of the mechanism which anchors the base of the rail to the rail ties. Rotation of the rail head must be prevented at all sections of the rail inasmuch as if a lateral load sufficient to rotate a rail head is applied to the head of a rail over a relatively long length of the rail, it is possible that the lateral load could cause the entire rail to roll over and ultimately collapse.

Rail braces are used to maintain the gage of a rail as well as to support a rail to resist lateral movement of the head of the rail. These braces typically have an upper surface which bears against a fishing surface formed on the under side the head of the rail and a lower surface which bears against a fishing surface formed on the top side of the base of the rail on the side of the rail opposite that engaged by the flange of the railroad car or locomotive wheel. Traditionally, rail braces have been anchored by being spiked to a wooden tie. More recently, it has become common practice to support railroad rails and rail braces on metal brace plates and the rails and rail braces are bolted to the brace plate.

In addition to the use of rail brace plates, it has become common practice to use adjustable rail braces which enable a rail brace to be tightened as it becomes necessary. In one type of adjustable brace one side of the base of the brace is set at an angle and this side directly engages a stop welded to a brace plate and set at a similar angle to thereby provide a wedging action of the brace between the rail and the stop. In another type of adjustable brace a wedge is interposed between a rail brace and a stop affixed to a brace plate. In both of these assemblies the brace must be driven into frictional engagement with the stop or the wedge to firmly secure the rail brace into abutting contact with the rail. Subsequent to the brace or brace and wedge assemblies being driven into position, the brace assembly may be secured by fasteners such as screws or nuts and bolts. It has been found that where screws or nuts and bolts are used to secure a rail brace assembly to a brace plate such fasteners may loosen over time making it necessary to periodically inspect the brace assembly to determine if fasteners have loosened and the braces have moved with respect to the rail.

Because of the time and expense involved in having maintenance personnel inspect and tighten fasteners which secure rail braces to rails, the rail industry has moved to use elastic fasteners such as spring clips to bias rail brace assemblies against rails. A modern adjustable rail brace assembly adapted to be mounted on a metal brace plate and using a spring clip type fastener may be seen in U.S. Pat. No. 6,517,008 assigned to the assignee of the instant invention.

It is common for railroads to use two or more families or groups of stock rails in trackwork. Rails having a weight of between 132 and 141 pounds per yard constitute a family or group of heavy or main line stock rail, whereas rails weighing between 112 and 119 pounds per yard constitute a family or group of light rail or non-main line stock rail. The rails of the light weight and heavy weight groups have different dimensions. The bases of heavy weight rails are wider than the bases of light weight rails. Additionally, the dimension between the base of the rail and the head of the rail is greater for heavy weight rails than the distance between the base of the rail and the head of the rail of light weight rails.

Because of the dimensional differences between the light weight and heavy weight rails, it has been necessary to utilize different rail braces and rail brace components for light weight and heavy weight rail groups or families. This necessitates manufacturing two different rail braces and also may require manufacturing two different rail brace wedges or require the repositioning of the stops on the rail plate. In addition, it also requires a different rail plate. This, of course, requires a greater of inventory of parts for rail brace assemblies. Additionally, rail braces are not easily identifiable in the field. Thus, if a brace assembly needs to be replaced, the maintenance crews must carefully examine the assembly to know which one to order or to install. The universal rail brace assembly of the instant invention overcomes these problems.

SUMMARY OF THE INVENTION

A rail brace assembly is adapted to buttress the head of a stock rail selected from one of two different stock rail groups mounted on a brace plate. The stock rail includes a head having a head fishing surface and a base having a base fishing surface. The brace assembly includes a brace plate having a bottom surface and a top surface with a rail support area defined in part by a longitudinally extending rail engaging area. A stop block assembly is affixed to the rail plate top surface. The rail brace is moveable between a first brace position in which it buttresses the head of a rail from a first stock rail group and a second brace position in which it buttresses the head of a rail from a second stock rail group, has a pair of spaced side walls, an upwardly facing top surface, first rail group head and base fishing surface contact areas, second rail group head and base fishing surface contact areas, a first rail group base plate contact surface, a second rail group base plate contact surface, a first rail group stop block assembly engagement surface and a second rail group stop block assembly engagement surface. A clip housing having a bore formed therein is mounted on the brace plate top surface. The rail brace assembly also comprises a resilient clip having first and second legs with the first leg extending into the clip housing bore and the second leg applying a force on the rail brace top surface tending to bias the rail brace into contact with the stock rail. When a stock rail from the first stock rail group is buttressed by the rail brace assembly, the rail brace is in the first brace position and the rail brace first rail group head and base fishing surface contact areas engage head and base fishing surfaces on the first rail group stock rail, the first rail group base plate contact surface contacts said base plate and the first rail group stop block assembly engagement surface engages the stop block assembly. When a stock rail from the second stock rail group is buttressed by the rail brace assembly, the rail brace is in the second brace position and the rail brace second rail group head and base fishing surface contact areas engage head and base fishing surfaces on the second rail group stock rail, the second rail group base plate contact surface contacts the brace plate and the second rail group stop block assembly engagement surface engages the stop block assembly.

DESCRIPTION OF THE PREFERRED EMBODIMENT

Figure 1:
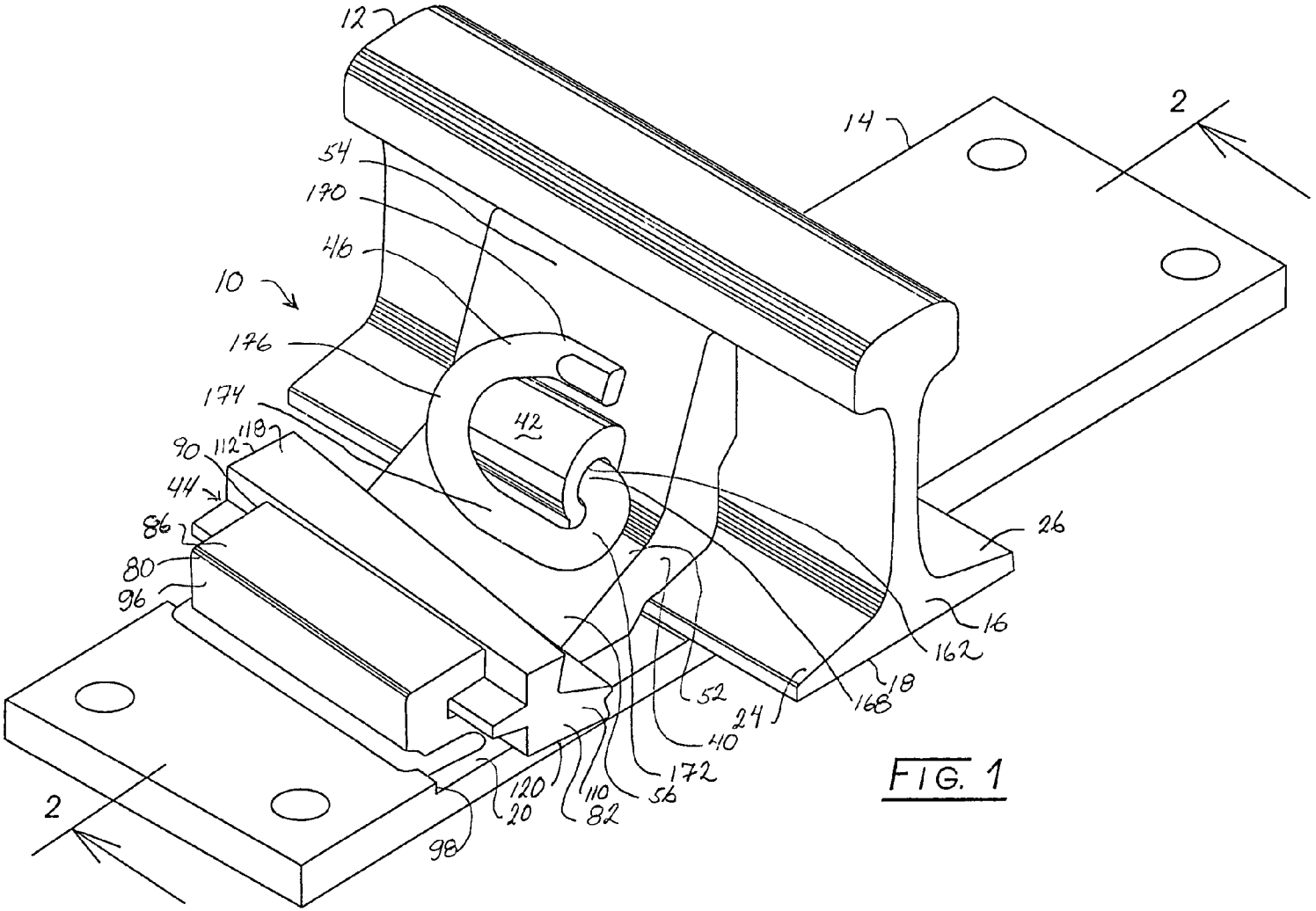
FIG. 1 is a perspective view of the universal rail brace of the instant invention.

Referring to the drawings, the universal rail brace assembly 10 of the instant invention and a stock rail 12 are shown seated upon a tie or brace plate 14 that is spiked, bolted or otherwise affixed to a railroad tie not show. Note number 12 H refers to a heavy rail group stock rail and number 12 L refers to a light rail group stock rail. Number 12 refers to stock rails generally. Stock rail 12 includes a generally laterally extending base 16 having a bottom surface 18 which rests upon a top surface 20 of brace plate 14 and is laterally restrained in one direction by a riser 22 formed on top surface 20 of brace plate 14. Base 16 also has a pair of inclined top surfaces 24 and 26 commonly referred to as base fishing surfaces. Stock rail 12 further includes a head 28 which is connected to base 16 by a vertical web 30 and which includes a top surface 32 which engages the treads of railroad car wheels and locomotive wheels, an inner gage or lateral surface 34 which engages the flanges of railroad car wheels and locomotive wheels, and a pair of an angled underside surfaces 36 and 38 which are commonly referred to as head fishing surfaces.

Railroads commonly use two or more families or groups of stock rails. Rails having a weight of between 132 and 141 pounds per yard constitute a family or group of heavy or mainline stock or traffic rails whereas rails weighing between 112 and 119 pounds per yard constitute a family or group of light rail or non-mainline stock or traffic rails. The parts of the stock rail 12 described above are common to both families or groups of stock rails. The rails of the light weight and heavy weight groups have different dimensions. The bases of heavy rail group rails are wider than the bases of light rail group rails. Additionally, the distance between the base of the rail and the head of the rail or the base fishing surface of the rail and the head fishing surface of the rail is greater for heavy rail group rails than the distance between the base of the rail and the head of the rail or the base fishing surface of the rail and the head fishing surface of light rail group rails. The universal rail brace assembly 10 of the instant invention is designed to be used in conjunction with stock rails of both light weight and heavy weight rail groups or families.

Generally, the universal rail brace assembly 10 of the instant invention is comprised of a rail brace 40, a clip housing 42, a stop block assembly 44 and a spring clip 46.

The function of the universal rail brace assembly 10 of the instant invention is to prevent the heads 28 of light weight and heavy weight families of stock rails 12 from rolling over or becoming angularly displaced with respect to the vertical axis of the rails 12 when rail traffic passes over them and to maintain the gage of the track. In part it accomplishes this by clamping the base 16 of light and heavy weight groups of rails 12 against brace plate riser 22 and by buttressing the side of the head 28 of stock rail 12 on the outside or non-gage side of the rail, as will be described in greater detail herein below.

As stated above, the universal rail brace assembly 10 of the instant invention may be used in connection with both light rail group stock rails or heavy rail group stock rails. It accomplishes this with the unique universal reversible rail brace 40 which now will be described in detail. Rail brace 40 has a pair of longitudinally spaced side walls 48 and 50 and a top surface 52 partially defined by an upper flat portion 54 and a lower flat portion 56. The upper and lower flat portions 54 and 56 of top surface 52 preferably are separated at an angle of approximately 135°. It has been found that an angle of approximately 135° provides optimum clamping force of the brace 40 by spring clip 46, as will be described herein after. In the preferred embodiment of the invention, a central rectangular opening 58 adapted to receive a spring clip housing 42 is formed in the body of brace 40. Rectangular opening 58 extends entirely through brace 40 and intersects portions of the upper and lower flat portions 54 and 56 of brace top surface 52.

Figure 2:
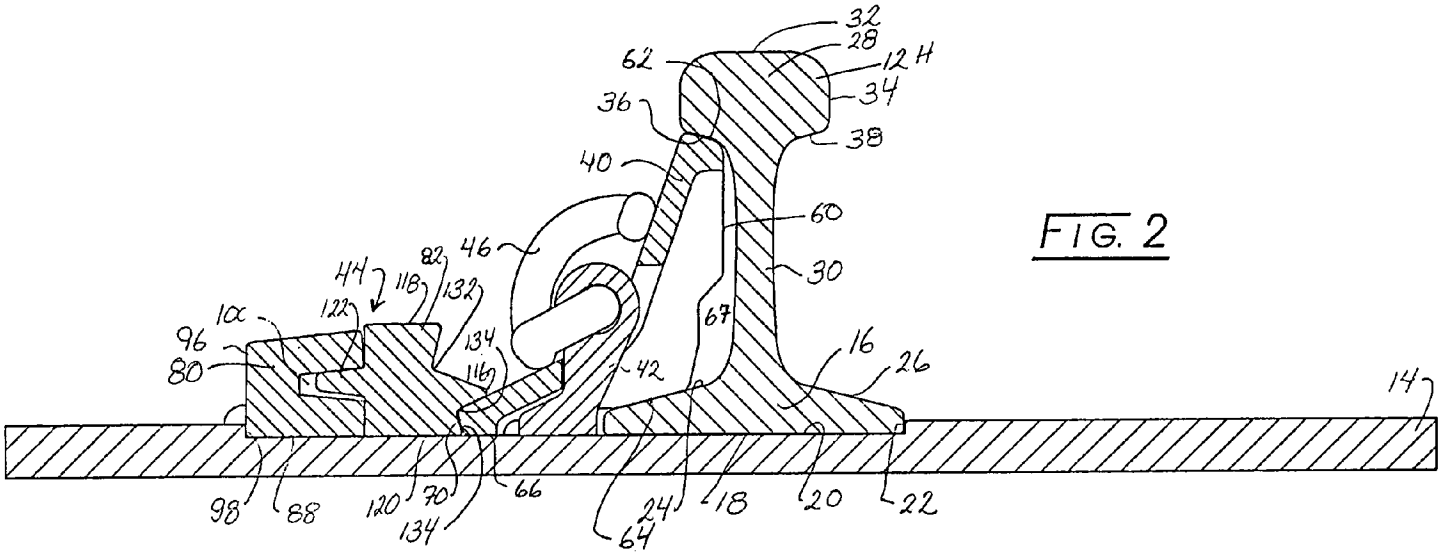
FIG. 2 is a cross sectional view of the universal rail brace of the instant invention arranged to buttress a first stock rail group rail.
Figure 6:
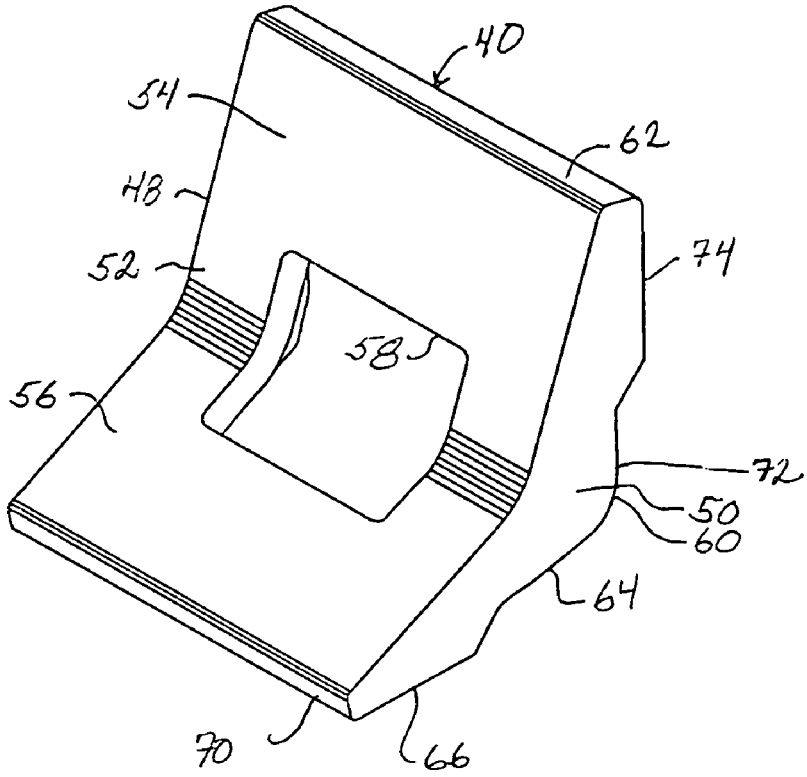
FIG. 6 is a perspective view of the rail brace of the instant invention.
Figure 7:
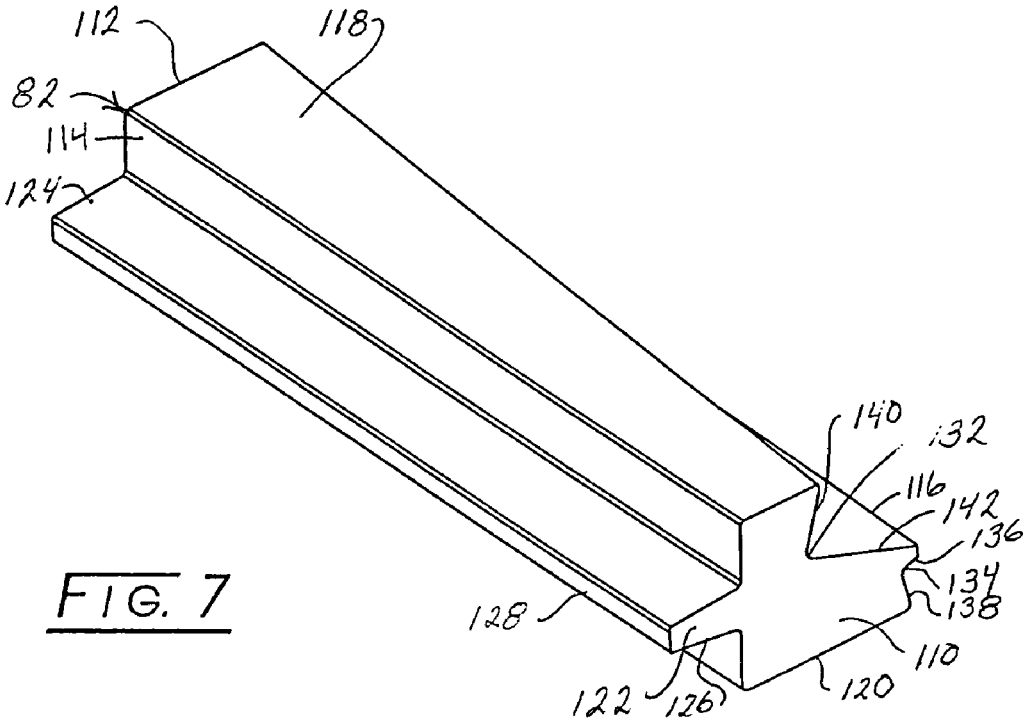
FIG. 7 is a perspective view of the wedge of the instant invention.
Figure 10:
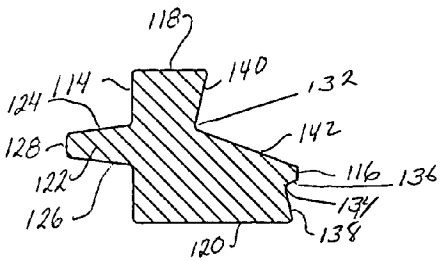
FIG. 10 is a view along line 10-10 of FIG. 8.
Figure 11:
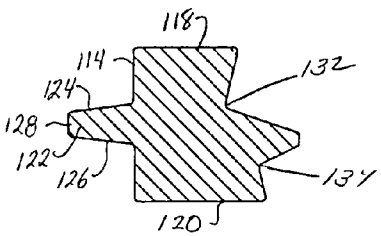
FIG. 11 is a view along line 11-11 of FIG. 8.
Figure 12:
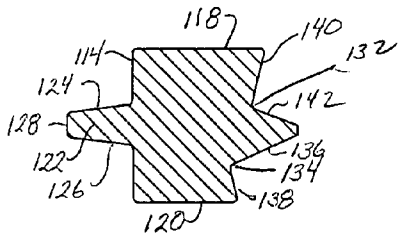
FIG. 12 is a view along line 12-12 of FIG. 8.
Figure 8:
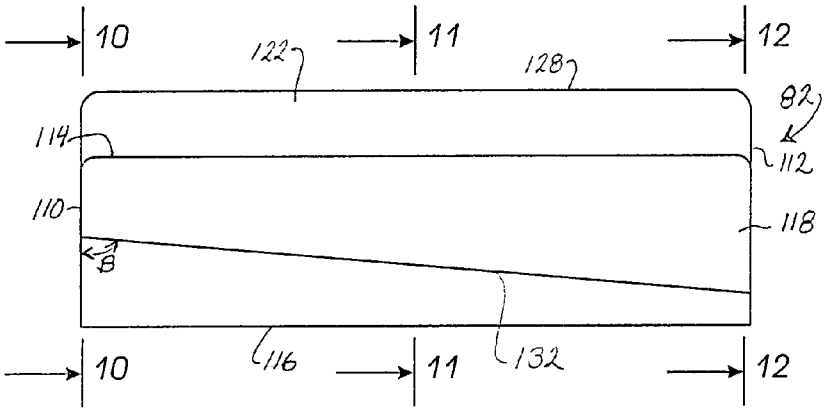
FIG. 8 is a top view of the wedge of FIG. 7.
Figure 9:
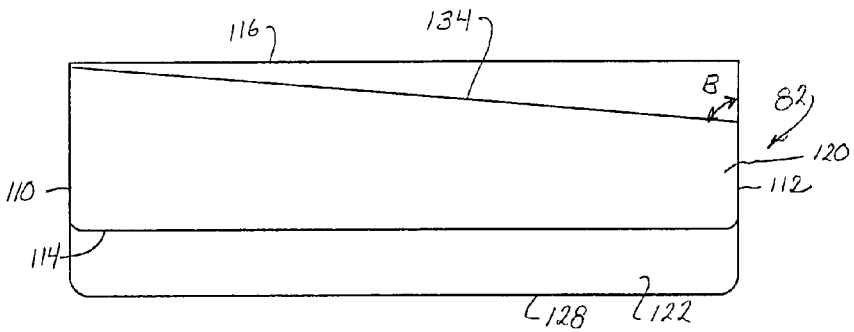
FIG. 9 is a view of the wedge of FIG. 8 rotated 180° about its longitudinal axis.

The rail brace 40 has a back surface 60 which has distinct and separate head and base fishing surface contact areas, brace plate contact areas and stop block assembly contact areas for both light rail group rails and heavy rail group rails. FIG. 2 illustrates rail brace 40 supporting a heavy rail group rail 12 H. Turning to FIGS. 2 and 6, it may be seen that back surface 60 has heavy rail group head and base fishing surface contact areas 62 and 64, respectively. These contact areas compliment the head and base fishing surfaces 24 and 36 formed on a heavy rail group stock rail 12 H. The heavy rail group head and base fishing surface contact areas 62 and 64 are generally planar and extend longitudinally of brace 40. Brace back surface 60 further includes a planar heavy rail group brace plate contact area 66. It should be noted that the back surface 60 of brace plate 40 is spaced outwardly of the stock rail web 30 a sufficient distance to provide a space 67 therebetween. In some instances a rail heater is inserted in this space.

Figure 3:
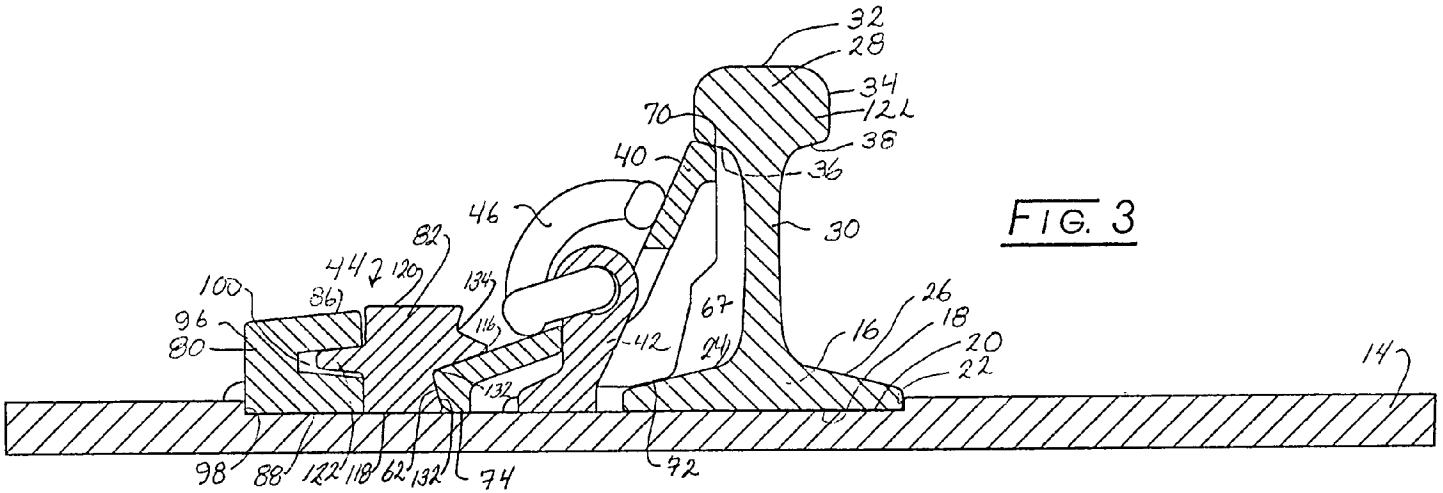
FIG. 3 is a cross sectional view similar to FIG. 2 of the universal rail brace of the instant invention arranged to buttress a second stock rail group rail.
Figure 4:
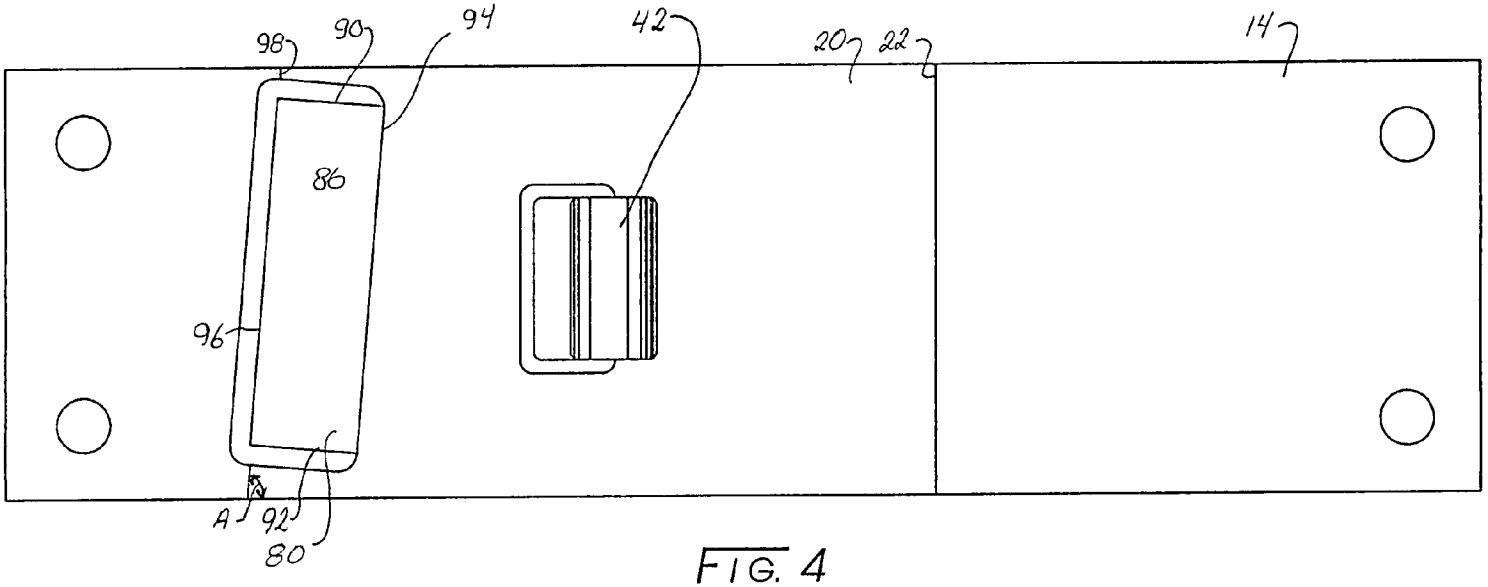
FIG. 4 is a plan view showing a brace plate with a clip housing and a stop block rigidly affixed to the top surface thereof.
Figure 5:
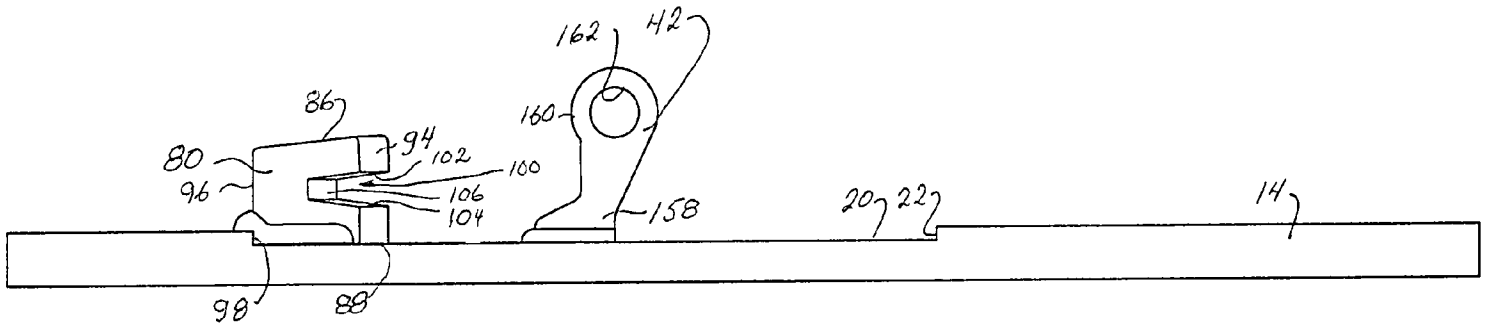
FIG. 5 is a front view of the brace plate of FIG. 4.

FIG. 3 illustrates rail brace 40 supporting a light rail group rail 12 L. Turning to FIGS. 3 and 6, it may be seen that the back surface 60 of rail brace 40 further includes generally planar light rail group head and base fishing surface contact areas 70 and 72, respectively. These contact areas compliment the head and base fishing surfaces 24 and 26 formed on a light rail group stock rail 12 L. The light rail group head and base fishing surface contact areas 70 and 72 are generally planar and extend longitudinally of brace 40. Brace back surface 60 also includes a planar light rail group base plate contact area 74.

It should be noted that the light and heavy rail group head fishing surface contact areas 70 and 62 alternately function to engage the stop block assembly 44 when brace 40 is reversed, as will be described herein below.

Stop block assembly 44 acts to bias brace 40 against stock rail 12 and is comprised of a stop block 80 and a wedge 82.

Referring to the drawings, stop block 80 has a planar top surface 86, a planar bottom surface 88, a pair of laterally spaced generally parallel end walls 90 and 92, a generally planar front wall 94 and a flat rear wall 96. The bottom surface 88 of stop block 80 rests on the top surface 20 of brace plate 14 and rear wall 96 engages a riser 98 set at a 1-in-12 angle A (4 degrees 45 minutes 49 seconds) in the top surface 20 of brace plate 14. Stop block 80 is secured in position on brace plate 14 by a plurality of welds along end walls 90 and 92 and rear wall 96. The front wall 94 of stop block 80 has a central longitudinally extending groove 100 formed therein. Front wall 94 of stop block 80 is symmetrical such that groove 100 is positioned an equal distance from the stop block top and bottom surfaces 86 and 88. The central longitudinally extending groove 100 is defined by a pair of spaced upper and lower rectangularly shaped walls 102 and 104 and a back wall 106. Upper and lower walls 102 and 104 taper inwardly at the same angle from stop block front wall 94 to groove back wall 106. In other words, the opening of central longitudinally extending groove 100 in front wall 94 is greater than the height of groove back wall 106. The distance from brace plate riser 22 which engages the inner side of stock rail 12 to riser 98 and stop block front wall 94 is fixed. It is the same for both light and heavy rail group rails 12 L and 12 H. Although risers 22 and 98 formed in the top surface 20 of brace plate 14 are shown as formed by recesses within the top surface, the risers also could be formed by welds or by stops affixed to a non-recessed or recessed planar top surface of brace plate 14.

Reversible wedge 82 which acts between stop block 80 and rail brace 40 to bias brace 40 into firm abutment with stock rail 12 may be seen by referring to FIGS. 7 through 12 of the drawings. Wedge 82 has a generally rectangular outer shape. Wedge 82 has a pair of laterally spaced generally parallel side walls 110 and 112, front and rear walls 114 and 116 which extend between side walls 110 and 112, and generally planar parallel top and bottom surfaces 118 and 120 which also extend between side walls 110 and 112. A longitudinally extending tongue 122 projects laterally outwardly of wedge front wall 114 and extends between wedge side walls 110 and 112. Tongue 122 has a trapezoidal cross-section with rectangular top and bottom surfaces 124 and 126 which taper inwardly at the same angle to an outer vertical wall 128. Wedge front wall 114 including tongue 122 is vertically symmetrical. Additionally, the shape of tongue 122 compliments the shape of stop block central longitudinally extending groove 100. Wedge 82 is sized such that when either the top or bottom wedge surfaces 118 and 120 rest upon the top surface 20 of brace plate 14 wedge tongue 122 fits within complimentary shaped stop block groove 100 and wedge front wall 114 engages stop block front wall 94.

Referring again to FIGS. 7 through 12, wedge rear wall 116 has a tapered longitudinally extending upper notch 132 defined by walls 140 and 142 formed therein, and a tapered longitudinally extending lower notch 134 defined by walls 136 and 138 formed therein. It may be seen that the upper and lower notches 132 and 134 taper in opposite directions. The angle of taper B for both the upper and lower notches is 1-in-12 (4 degrees 45 minutes 49 seconds) which is the same as the angular offset of stop block 80 on brace plate 14. Additionally, it may be seen that the depths of upper and lower notches 132 and 134 are different. Upper notch 132 is deeper than lower notch 134. Upper notch 132 has its greatest depth adjacent wedge side wall 110 and tapers to a lesser dimension adjacent side wall 112. In contrast thereto, lower notch 134 has its greatest depth adjacent wedge side wall 112 and tapers to a lesser dimension adjacent wedge side wall 110. The reason the upper and lower notches taper in opposite directions and have different depths resides in the fact that wedge 82 is rotatable about its longitudinal axis between a first position in which bottom surface 120 rests upon brace plate top surface 20 such that tapered lower notch 134 is adjacent brace plate top surface 20, is parallel thereto and engages light rail group rail head fishing surface 70. Heavy rail group rail head fishing surface 62 projects laterally from brace plate riser 22 a greater distance than light rail group rail head fishing surface 70 and a second position in which top surface 118 engages brace plate top surface 20 and tapered upper notch 132 resides adjacent brace plate top surface 20 and is parallel thereto. In either the first or second positions of wedge 82, wedge tongue 122 is adapted to fit within complimentary shaped stop block groove 100. It may be observed that when wedge 82 is in the first position with bottom surface 120 resting upon the top surface 20 of brace plate 14 and tongue 122 is inserted within stop block groove 100 the walls 136 and 138 defining tapered lower notch 134 extend parallel to stock rail 12 H and parallel to brace plate light and heavy rail group head fishing surface contact areas 70 and 62. This results because the wedge taper angle B is the same as and compliments the angular offset of stop block 80. Similarly, when wedge 82 is rotated such that top surface 118 rests upon the top surface 20 of brace plate 14 and wedge tongue 122 is inserted within stop block groove 100, the walls 140 and 142 defining tapered upper notch 132 extend parallel to stock rail 12 L and to light and heavy rail group head fishing surface contact areas 70 and 62. Again, this results because in this position of wedge 82, the wedge taper angle B is the same as and compliments stop block offset angle A. In summation it may be seen that the tapered upper and lower notches 132 and 134 extend parallel to stock rails 12 L and 12 H and to the light and heavy rail group head fishing surface contact surface areas 70 and 62 when wedge 82 is interposed between these surfaces and stop block 80.

Turning to FIG. 2 of the drawings, it may be seen that when the stock rail 12 H, being buttressed by universal rail assembly 10 is a heavy rail group rail, rail brace heavy rail group head fishing surface contact area 62 contacts rail head fishing surface 36, heavy rail group base fishing surface contact area 64 contacts base rail fishing surface 24 and heavy rail group base plate contact area 66 engages the top surface 20 of brace plate 14. In this position of rail brace 40, light rail group head fishing surface contact area 70 extends parallel to stock rail 12 H adjacent lower notch 134 of wedge 82 of stop block assembly 44. Rail brace 40 is secured in position against stock rail 12 H by reversible wedge 82 inserted between fixed stop block 80 and brace 40. Where brace 40 is supporting a heavy rail group member rail, wedge 82 must be rotated such that bottom surface 120 engages the top surface 20 of brace plate 14 and tapered lower notch 134 engages light rail group head fishing surface contact area 70 of brace 40. Wedge 82 when driven in position biases or wedges brace 40 against stock rail 12 H. Wedge 82 may be retained in position by a pin, not shown, within a wedge bore adjacent side wall 112. The pin projects downwardly beyond stop block end wall 90.

When brace 40 is buttressing a stock rail 12 L selected from the light rail group, as illustrated in FIG. 3 of the drawings, light rail group head fishing surface contact area 70 engages stock rail head fishing surface 36 and light rail group base fishing surface contact area 72 engages stock rail base fishing surface 24. Simultaneously, light rail group base plate contact area 74 engages the top surface 20 of brace plate 14. In this position of rail brace 40, heavy rail group rail head fishing surface contact area 62 extends parallel to stock rail 12 L adjacent upper notch 132 of wedge 82. Also in this position of rail brace 40, wedge 82 is rotated such that planar top surface 118 engages the top surface 20 of brace plate 14 and tapered upper notch 132 is adjacent brace plate top surface 20. Wedge 82 is positioned such that tongue 122 enters stop block groove 100 and heavy rail group head fishing surface contact area 62 is received within tapered upper notch 132. Wedge 82 when driven in position biases brace 40 against stock rail 12 L. Wedge 82 may be retained in this position by a pin, not shown, inserted within a bore adjacent wedge end 110 which projects beyond and overlies stop block end wall 90.

Spring clip 46 is inserted in clip or fastener housing 42 subsequent to the insertion of wedge 82 to further bias rail brace 40 against stock rail 12 and to assist in preventing any rotational movement of brace 40 and in preventing lateral movement of rail brace 40. Turning to the drawings, a clip housing 42 has a base portion 158 rigidly affixed to the top surface 20 of brace plate 14 and an upper portion 160 with a through bore 162 which extends parallel to the stock rail 12. Clip housing 42 is dimensioned such that when rail brace 40 engages the head and base fishing surfaces 36 and 24 of stock rail 12 and wedge 82 is driven in position between rail brace 40 and stop block 80, clip housing 42 projects upwardly through rectangular opening 58 in rail brace 40 such that the walls defining clip receiving bore 162 project slightly above the top surface 52 of rail brace 40.

Such a clip housing may be seen in U.S. Pat. No. 6,517,008 B1 assigned to the assignee of the instant application.

As stated above, elastic fastener or spring clip 46 is driven into and works in conjunction with clip or fastener housing 42 to assist wedge 82 in buttressing rail brace 40 against stock rail 12. The unitary elastic fastener 46 has a first straight leg 168 adapted to reside within fastener bore 162 and a second parallel straight leg 170 at the opposite end of the fastener. See FIG. 1. A curved section 172 at one end of straight leg 168 is connected to a generally straight section 174 which extends generally parallel to the straight legs 168 and 170. A curved section 176 connects straight section 174 with straight leg 170. Such an elastic fastener may be obtained from Pandrol USA of Bridgeport, N.J.

As mentioned above, elastic fastener 46 is driven into the fastener receiving bore 162 of fastener housing 42 after wedge 82 has been driven into position between stop block 80 and rail brace 40 as described above. A sledge hammer or other such tool may be used to drive straight leg 168 into fastener bore 162. After this has occurred, curved section 172 and straight section 174 of elastic fastener 46 engage the lower flat portion 56 of rail brace top surface 52. At the same time straight leg 170 engages upper flat portion 54 of rail brace top surface 52. The forces applied by elastic fastener 46 help prevent brace 40 from rotating away from stock rail 12.

Drawing FIG. 2 illustrates the universal rail brace assembly 10 of the instant invention used with a heavy or primary rail group stock rail 12 H. In order to use universal rail brace assembly 10 with a light or secondary rail group stock rail 12 L, rail brace 40 is rotated 180° such that upper flat portion 54 and lower flat portion 56 of rail brace top surface 52 change places. Thereafter, rail brace 40 is inserted into position such that clip or fastener housing 42 projects through the rectangular opening 58 or rail brace 40. In this position, light rail group rail brace head and base fishing surface contact areas 70 and 72 engage the head and base fishing surfaces 36 and 24 of light rail group stock rail 12 L. Simultaneously, light rail group base plate contact area 74 engages the top surface 20 of brace plate 14 and heavy rail group rail brace head fishing surface contact area 62 is adjacent wedge 82. Wedge 82 is rotated 180° such that planar top surface 118 engages the top surface 20 of brace plate 14. Thereafter, wedge 82 is driven into position such that heavy rail group head fishing surface contact area 62 is driven into contact with wedge tapered upper notch 132 and tongue 122 resides within stop block groove 100. Subsequent to wedge 82 being driven into a position in which rail brace 40 is wedged against traffic rail 12 L with the appropriate degree of force, a pin may be inserted in a bore to prevent longitudinal movement of wedge 82 and straight leg 168 of elastic fastener 46 is driven into fastener housing receiving bore 162 to thereby enable the elastic fastener 46 to further clamp or bias rail brace 40 against stock rail 12 L.

In the preferred embodiment of the instant invention reversible rail brace 40 is used with a rotatable wedge 82 having tapered upper and lower notches 132 and 134 to receive a head fishing surface area of brace 40. Reversible rail brace 40 also may be used with two different wedges to receive the two different head fishing surface areas of rail brace 40. One such wedge would be similar to wedge 82 without tapered upper notch 132 and the other would be similar to wedge 82 without tapered lower notch 134. Of course, the tapered notches would be angled in the same direction opposite the offset of stop block angle A.

From the above, it may be seen that the universal rail brace assembly 10 of the instant invention may be used with both light and heavy weight rail groups of stock rails. To change from one group of rail to another involves rotating rail brace 40 180° about its longitudinal axis to the proper position and also rotating wedge 82 180° to the proper position. In order to ensure that rail brace 40 and wedge 82 are in the proper position with a particular rail group stock rail, the rail brace 40 and wedge 82 are marked for proper alignment with the respective rail groups.

Although the preferred embodiment of the invention has been disclosed in the instant application, it will be apparent to those skilled in the art that certain changes may be made in the above-described apparatus without departing from the scope of the invention herein involved. It is intended that all matter contained in the description or shown in the accompanying drawings shall be interpreted as illustrative and not in a limiting sense.

We claim as our invention:

1. A rail brace assembly adapted to buttress the stock rail head of a rail selected from one of two different stock rail groups mounted on the brace plate top surface, which rail brace assembly comprises:

a stop block assembly affixed to said brace plate top surface;

a rail brace movable between a first brace position in which it buttresses said head of a rail from a first stock rail group and a second brace position in which it buttresses said head of a rail from a second stock rail group, said rail brace having a pair of spaced side walls, an upwardly facing top surface, first rail group head and base fishing surface contact areas, second rail group head and base fishing surface contact areas, a first rail group brace plate contact surface, a second rail group brace plate contact surface;

a clip housing having a bore formed therein and mounted on said brace plate top surface;

a resilient clip having first and second legs, said first leg extending into said clip housing bore and said second leg applying a force on said rail brace top surface tending to bias said rail brace into contact with said stock rail; and wherein when a stock rail from said first stock rail group is buttressed by said rail brace assembly said rail brace is in said first brace position and said rail brace first rail group head and base fishing surface contact areas engage head and base fishing surfaces on said first rail group stock rail, said first rail group brace plate contact surface contacts said brace plate and said second rail group head fishing surface contact area engages said stop block assembly, and when a stock rail from said second stock rail group is buttressed by said rail brace assembly said rail brace is in said second brace position and said rail brace second rail group head and base fishing surface contact areas engage head and base fishing surfaces on said second group stock rail, said second rail group brace plate contact surface contacts said brace plate and said first rail group head fishing surface contact area engages said stop block assembly, said stop block assembly comprising a stop block rigidly affixed to said brace plate top surface and a rotatable wedge movable between a first wedge position and a second wedge position interposed between said rail brace and said stop block to bias said rail brace into engagement with a stock rail;

said stop block having a wedge engagement surface;

said wedge having a top, a first end, a second end, a bottom, a first side with a first rail brace contact area and a second rail brace contact area and a second side with a stop block engagement surface; and wherein said second rail group head fishing surface of said rail brace contacts said wedge first rail brace contact area and said wedge stop block engagement surface engages said stop block when said rail brace is in said first brace position and said wedge is in said first wedge position and said first rail group head fishing surface of said rail brace contacts said wedge second rail brace contact area and said wedge stop block engagement surface engages said stop block when said rail brace is in said second brace position and said wedge is in said second wedge position;

said rail brace and said wedge forming an interface, and wherein said stop block wedge engagement surface is non-parallel to said stock rail; and said wedge first rail brace contact surface has a longitudinal taper in one direction and said wedge second rail brace contact surface has a longitudinal taper in the opposite direction to make said interface of said rail brace and said wedge parallel when said rail brace is in one of said first or said second brace position.

2. The rail brace assembly of claim 1 wherein the distance between a brace plate riser which engages the inner ends of the first and second rail group stock rails and said stop block is fixed.

3. The rail brace assembly of claim 1 wherein said wedge top and bottom surfaces are substantially planar and parallel.

4. The rail brace assembly of claim 1 wherein one of said wedge top and bottom surfaces contacts said brace plate when said wedge is in said first wedge position and the other of said wedge top and bottom surfaces contacts said brace plate when said wedge is in said second wedge position.

5. The rail brace assembly of claim 1 wherein said rail brace top surface has an upper flat portion and a lower flat portion and said upper and lower flat portions are separated at an angle of approximately 135 degrees.

6. The rail brace assembly of claim 1 wherein said rail brace top surface has an opening formed therein for receiving said clip housing.

7. The rail brace assembly of claim 1 wherein said wedge first rail brace contact area is partially defined by a first longitudinally extending groove formed in said wedge first side and said wedge second rail brace contact area is partially defined by a second longitudinally extending groove formed in said wedge first side.

8. The rail brace assembly of claim 7 wherein the depth of said first longitudinally extending groove increases from said first wedge end to said second wedge end.

9. The rail brace assembly of claim 7 wherein the depth of said second longitudinally extending groove increases from said second wedge end to said first wedge end.

10. The rail brace assembly of claim 7 wherein one of said first and second longitudinally extending grooves extends adjacent said wedge top surface, the other of said first and second longitudinally extending grooves extends adjacent said wedge bottom surface and said one and said other grooves are spaced equal distance from their respective wedge top and bottom surfaces.

11. The rail brace assembly of claim 1 wherein said wedge second side stop block engagement surface is formed in part by a longitudinally extending tongue projecting laterally of said wedge second side.

12. The rail brace assembly of claim 11 wherein said longitudinally extending tongue is located centrally on said wedge second side.

13. The rail brace assembly of claim 1 wherein said stop block has an inward side with a central longitudinally extending groove which partially defines said wedge engagement surface.

14. The rail brace assembly of claim 1 wherein said wedge second side is vertically symmetrical.

15. A rail brace assembly adapted to buttress the stock rail head of a rail selected from one of two different stock rail groups mounted on the brace plate top surface, which rail brace assembly comprises:

a stop block assembly affixed to said brace plate top surface;

a rail brace movable between a first brace position in which it buttresses said head of a rail from a first stock rail group and a second brace position in which it buttresses said head of a rail from a second stock rail group, said rail brace having a pair of spaced side walls, an upwardly facing top surface, first rail group head and base fishing surface contact areas, second rail group head and base fishing surface contact areas, a first rail group brace plate contact surface, a second rail group brace plate contact surface a clip housing having a bore formed therein and mounted on said brace plate top surface;

a resilient clip having first and second legs, said first leg extending into said clip housing bore and said second leg applying a force on said rail brace top surface tending to bias said rail brace into contact with said stock rail; and wherein when a stock rail from said first stock rail group is buttressed by said rail brace assembly said rail brace is in said first brace position and said rail brace first rail group head and base fishing surface contact areas engage head and base fishing surfaces on said first rail group stock rail, said first rail group brace plate contact surface contacts said brace plate and said second rail group head fishing surface contact area engages said stop block assembly and when a stock rail from said second stock rail group is buttressed by said rail brace assembly said rail brace is in said second brace position and said rail brace second rail group head and base fishing surface contact areas engage head and base fishing surfaces on said second group stock rail, said second rail group brace plate contact surface contacts said brace plate and said first rail group head fishing surface contact area engages said stop block assembly, said stop block assembly comprising a stop block rigidly affixed to said brace plate top surface and a rotatable wedge movable between a first wedge position and a second wedge position interposed between said rail brace and said stop block to bias said rail brace into engagement with a stock rail;

said stop block having a wedge engagement surface;

said wedge having a top, a first end, a second end, a bottom, a first side with a first rail brace contact area and a second rail brace contact area and a second side with a stop block engagement surface; and wherein said second rail group head fishing surface of said rail brace contacts said wedge first rail brace contact area and said wedge stop block engagement surface engages said stop block when said rail brace is in said first brace position and said wedge is in said first wedge position and said first rail group head fishing surface of said rail brace contacts said wedge second rail brace contact area and said wedge stop block engagement surface engages said stop block when said rail brace is in said second brace position and said wedge is in said second wedge position;

wherein said wedge first rail brace contact area is partially defined by a first longitudinally extending groove formed in said wedge first side and said wedge second rail brace contact area is partially defined by a second longitudinally extending groove formed in said wedge first side; and wherein the depth of said first longitudinally extending groove increases from said first wedge end to said second wedge end.

16. A rail brace assembly adapted to buttress the stock rail head of a rail selected from one of two different stock rail groups mounted on the brace plate top surface, which rail brace assembly comprises:

a stop block assembly affixed to said brace plate top surface;

a rail brace movable between a first brace position in which it buttresses said head of a rail from a first stock rail group and a second brace position in which it buttresses said head of a rail from a second stock rail group, said rail brace having a pair of spaced side walls, an upwardly facing top surface, first rail group head and base fishing surface contact areas, second rail group head and base fishing surface contact areas, a first rail group brace plate contact surface, a second rail group brace plate contact surface;

a clip housing having a bore formed therein and mounted on said brace plate top surface;

a resilient clip having first and second legs, said first leg extending into said clip housing bore and said second leg applying a force on said rail brace top surface tending to bias said rail brace into contact with said stock rail; and wherein when a stock rail from said first stock rail group is buttressed by said rail brace assembly said rail brace is in said first brace position and said rail brace first rail group head and base fishing surface contact areas engage head and base fishing surfaces on said first rail group stock rail, said first rail group brace plate contact surface contacts said brace plate and said second rail group head fishing surface contact area engages said stop block assembly and when a stock rail from said second stock rail group is buttressed by said rail brace assembly said rail brace is in said second brace position and said rail brace second rail group head and base fishing surface contact areas engage head and base fishing surfaces on said second group stock rail, said second rail group brace plate contact surface contacts said brace plate and said first rail group head fishing surface contact area engages said stop block assembly, said stop block assembly comprising a stop block rigidly affixed to said brace plate top surface and a rotatable wedge movable between a first wedge position and a second wedge position interposed between said rail brace and said stop block to bias said rail brace into engagement with a stock rail;

said stop block having a wedge engagement surface;

said wedge having a top, a first end, a second end, a bottom, a first side with a first rail brace contact area and a second rail brace contact area and a second side with a stop block engagement surface; and wherein said second rail group head fishing surface of said rail brace contacts said wedge first rail brace contact area and said wedge stop block engagement surface engages said stop block when said rail brace is in said first brace position and said wedge is in said first wedge position and said first rail group head fishing surface of said rail brace contacts said wedge second rail brace contact area and said wedge stop block engagement surface engages said stop block when said rail brace is in said second brace position and said wedge is in said second wedge position;

wherein said wedge first rail brace contact area is partially defined by a first longitudinally extending groove formed in said wedge first side and said wedge second rail brace contact area is partially defined by a second longitudinally extending groove formed in said wedge first side; and wherein the depth of said second longitudinally extending groove increases from said second wedge end to said first wedge end.

* * * * *